US009368905B2

(12) United States Patent
Ledgerwood et al.

(10) Patent No.: US 9,368,905 B2
(45) Date of Patent: Jun. 14, 2016

(54) POTTING COMPOUND CHAMBER DESIGNS FOR ELECTRICAL CONNECTORS

(71) Applicants: Adam Douglas Ledgerwood, Syracuse, NY (US); Alvah Benjamin Aldrich, Geneva, NY (US); Joseph Michael Manahan, Manlius, NY (US)

(72) Inventors: Adam Douglas Ledgerwood, Syracuse, NY (US); Alvah Benjamin Aldrich, Geneva, NY (US); Joseph Michael Manahan, Manlius, NY (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/337,985

(22) Filed: Jul. 22, 2014

(65) Prior Publication Data

US 2016/0028182 A1 Jan. 28, 2016

(51) Int. Cl.

| | |
|---|---|
| ***H01R 13/40*** | (2006.01) |
| ***H01R 13/52*** | (2006.01) |
| ***H01R 13/527*** | (2006.01) |

(52) U.S. Cl.

CPC ..... *H01R 13/5216* (2013.01); *H01R 13/527* (2013.01)

(58) Field of Classification Search

CPC ... H01R 13/5612; H01R 13/527; H01R 13/70
USPC ..... 439/625, 936, 587, 271, 276, 937
See application file for complete search history.

(56) References Cited

U.S. PATENT DOCUMENTS

| | | | | |
|---|---|---|---|---|
| 3,585,563 | A | 6/1971 | Hegle | |
| 3,739,128 | A * | 6/1973 | Kaesser | H01H 37/04 200/293 |
| 3,761,601 | A * | 9/1973 | Kaesser | H01H 9/041 174/151 |
| 4,335,932 | A | 6/1982 | Herrmann, Jr. | |
| 4,795,372 | A | 1/1989 | Kobler | |
| 4,893,215 | A | 1/1990 | Urushiwara et al. | |
| 5,645,451 | A * | 7/1997 | Ohsumi | H01R 13/5208 277/637 |
| 6,193,536 | B1 * | 2/2001 | Sanuki | H01R 13/521 439/271 |
| 6,964,575 | B1 | 11/2005 | Sailor | |
| 7,014,502 | B2 * | 3/2006 | Rasmussen | H01Q 1/1207 439/578 |
| 7,118,646 | B2 | 10/2006 | Hunkeler | |
| 7,238,036 | B2 | 7/2007 | Sato et al. | |
| 7,445,481 | B2 * | 11/2008 | Nagashima | H01R 13/521 439/276 |
| 7,821,791 | B2 | 10/2010 | Popp et al. | |
| 8,657,609 | B2 | 2/2014 | Yanagisawa et al. | |

(Continued)

*Primary Examiner* — Hae Moon Hyeon
*Assistant Examiner* — Peter G Leigh
(74) *Attorney, Agent, or Firm* — King & Spalding LLP

(57) ABSTRACT

An electrical chamber is disclosed herein. The electrical chamber can include at least one wall forming a cavity, where the at least one wall includes a first end and an inner surface. The electrical chamber can also include a first isolation zone disposed on the inner surface at a first distance from the first end, where the first isolation zone is formed by a first bridge, a first underhang, and a first isolation zone inner surface, where the first bridge protrudes inward toward the cavity from the inner surface, and where the first underhang extends from a distal end of the first bridge. The cavity can be configured to receive at least one electrical conductor. The cavity and the first isolation zone can be configured to receive a potting compound.

20 Claims, 5 Drawing Sheets

(56) References Cited

U.S. PATENT DOCUMENTS 8,814,606 B2 * 8/2014 Endo ..... H01R 13/405 439/736
2006/0286845 A1 12/2006 Hinze
2007/0212918 A1 * 9/2007 Gruebel ..... H01R 13/4538 439/271
2009/0057006 A1 3/2009 Kishibata et al.
2009/0145656 A1 6/2009 Tschudin
2009/0173393 A1 * 7/2009 Grabert ..... F16K 17/162 137/68.23
2012/0236479 A1 9/2012 Tamai et al.
2013/0223037 A1 8/2013 Mikami
2013/0224979 A1 * 8/2013 Sato ..... H01R 13/5202 439/271
2014/0076772 A1 3/2014 Azumi et al.
2014/0235088 A1 * 8/2014 Fawcett ..... H01R 13/53 439/349
2014/0329399 A1 * 11/2014 Ohsumi ..... H01R 13/5202 439/276
2015/0171543 A1 * 6/2015 Sittner ..... H01R 13/405 439/271

* cited by examiner

POTTING COMPOUND CHAMBER DESIGNS FOR ELECTRICAL CONNECTORS

TECHNICAL FIELD

Embodiments of the invention relate generally to electrical connectors, and more particularly to systems, methods, and devices for potting compound chamber designs for electrical connectors.

BACKGROUND

Electrical connectors known in the art are configured to couple to a single device or a number of devices having the same voltage and/or current requirements. In some cases, a potting compound is used to fill at least a portion of a chamber within an electrical connector. The potting compound can serve one or more of a number of purposes, including but not limited to providing electrical isolation of one or more components within the chamber and providing a barrier to prevent fluids from traversing through the chamber. As another example, the potting compound can be used to withstand extreme service temperatures over a long service life (accelerated in test by higher temperatures) while preventing the passage of hazardous gas and flame therethrough. The potting compound can be designed to serve these purposes within the chamber under a certain amount of pressure.

SUMMARY

In general, in one aspect, the disclosure relates to an electrical chamber. The electrical chamber can include at least one wall forming a cavity, where the at least one wall has a first end and an inner surface. The electrical chamber can also include a first isolation zone disposed in the inner surface at a first distance from the first end, where the first isolation zone is formed by a first bridge, a first underhang, a first roof, and a first isolation zone inner surface, where the first bridge and the first roof each protrudes inward toward the cavity from the inner surface, and where the first underhang extends from a distal end of the first bridge. The isolation zone inner surface can be part of the inner surface. The cavity can be configured to receive at least one electrical conductor. The cavity and the first isolation zone can be configured to receive a potting compound.

In another aspect, the disclosure can generally relate to an electrical connector. The electrical connector can include an electrical chamber having at least one wall forming a cavity, where the at least one wall has a first end and an inner surface. The electrical chamber of the electrical connector can also have a first isolation zone disposed in the inner surface at a first distance from the first end, where the first isolation zone is formed by a first bridge, a first underhang, a first roof, and a first isolation zone inner surface, where the first bridge protrudes inward toward the cavity from the inner surface, where the first isolation zone inner surface is part of the inner surface, and where the first underhang extends from a distal end of the first bridge. The electrical connector can also include at least one electrical conductor disposed within the cavity. The electrical connector can further include a potting compound disposed within the cavity and the first isolation zone.

These and other aspects, objects, features, and embodiments will be apparent from the following description and the appended claims.

BRIEF DESCRIPTION OF THE DRAWINGS

The drawings illustrate only example embodiments of potting compound chamber designs for electrical connectors and are therefore not to be considered limiting of its scope, as potting compound chamber designs for electrical connectors may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
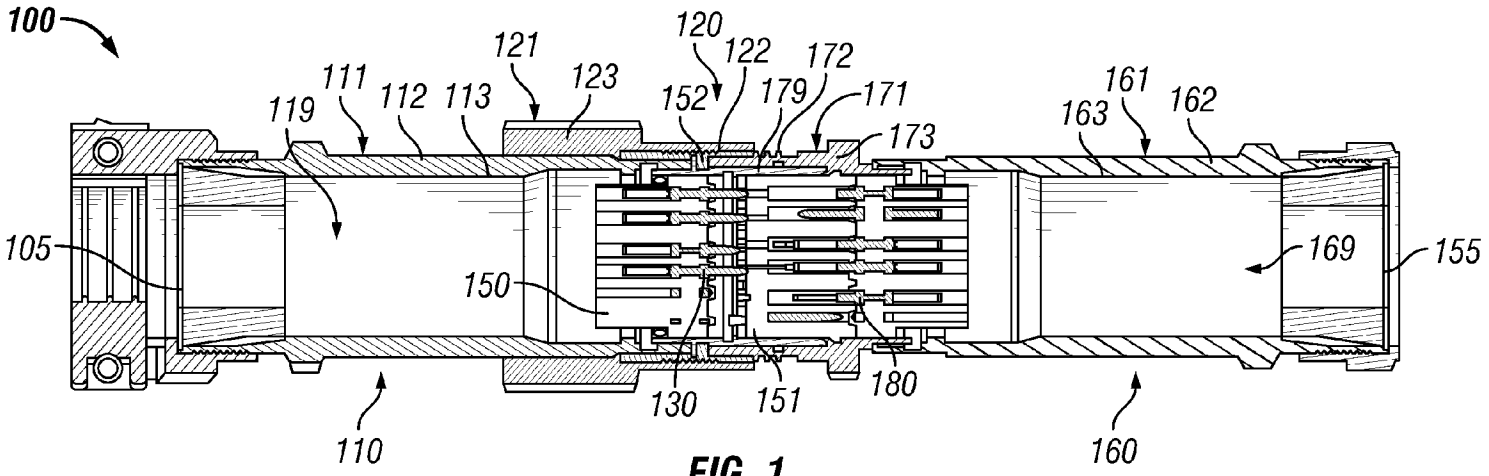
FIG. 1 (Prior Art)
FIG. 1 shows an electrical connector currently known in the art.

The example embodiments discussed herein are directed to systems, apparatuses, and methods of potting compound chamber designs for electrical connectors. While the example potting compound chamber designs for electrical connectors shown in the Figures and described herein are directed to electrical connectors, example potting compound chamber designs for electrical connectors can also be used with other devices aside from electrical connectors, including but not limited to instrumentation devices, electronics devices, light fixtures, hazardous area sealing fittings, lighting for restricted breathing, control devices, and load cells. Thus, the examples of potting compound chamber designs for electrical connectors described herein are not limited to use with electrical connectors. An example electrical connector can include an electrical connector end that is coupled to a complementary electrical connector end.

Any example electrical connector, or portions (e.g., features) thereof, described herein can be made from a single piece (as from a mold). When an example electrical connector or portion thereof is made from a single piece, the single piece can be cut out, bent, stamped, and/or otherwise shaped to create certain features, elements, or other portions of a component. Alternatively, an example electrical connector (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, fasten, and/or perform other functions aside from merely coupling. In addition, each component and/or feature described herein can be made of one or more of a number of suitable materials, including but not limited to metal, rubber, and plastic.

A coupling feature (including a complementary coupling feature) as described herein can allow one or more components and/or portions of an electrical connector (e.g., a first connector end) to become mechanically and/or electrically coupled, directly or indirectly, to another portion (e.g., a second connector end) of the electrical connector. A coupling feature can include, but is not limited to, a conductor, a conductor receiver, portion of a hinge, an aperture, a recessed area, a protrusion, a slot, a spring clip, a tab, a detent, and mating threads. One portion of an example electrical connector can be coupled to another portion of an electrical connector by the direct use of one or more coupling features.

In addition, or in the alternative, a portion of an example electrical connector (e.g., an electrical connector end) can be coupled to another portion of the electrical connector (e.g., a complementary electrical connector end) using one or more independent devices that interact with one or more coupling features disposed on a component of the electrical connector. Examples of such devices can include, but are not limited to, a pin, a hinge, a fastening device (e.g., a bolt, a screw, a rivet), and a spring. One coupling feature described herein can be the same as, or different than, one or more other coupling features described herein. A complementary coupling feature as described herein can be a coupling feature that mechanically couples, directly or indirectly, with another coupling feature.

As defined herein, an electrical connector for which example potting compound chamber designs are used can be any type of connector end, enclosure, plug, or other device used for the connection and/or facilitation of one or more electrical conductors carrying electrical power and/or control signals. As described herein, a user can be any person that interacts with example potting compound chamber designs for electrical connectors or a portion thereof. Examples of a user may include, but are not limited to, an engineer, an electrician, a maintenance technician, a mechanic, an operator, a consultant, a contractor, a homeowner, and a manufacturer's representative.

The potting compound chamber designs for electrical connectors described herein, while within their enclosures, can be placed in outdoor environments. In addition, or in the alternative, example potting compound chamber designs for electrical connectors can be subject to extreme heat, extreme cold, moisture, humidity, high winds, dust, chemical corrosion, and other conditions that can cause wear on the potting compound chamber designs for electrical connectors or portions thereof. In certain example embodiments, the potting compound chamber designs for electrical connectors, including any portions thereof, are made of materials that are designed to maintain a long-term useful life and to perform when required without mechanical failure.

In addition, or in the alternative, example potting compound chamber designs for electrical connectors can be located in hazardous and/or explosion-proof environments. In the latter case, the electrical connector (or other enclosure) in which example potting compound chamber designs for electrical connectors are disposed can be integrated with an explosion-proof enclosure (also known as a flame-proof enclosure). An explosion-proof enclosure is an enclosure that is configured to contain an explosion that originates inside, or can propagate through, the enclosure. Further, the explosion-proof enclosure is configured to allow gases from inside the enclosure to escape across joints of the enclosure and cool as the gases exit the explosion-proof enclosure.

The joints are also known as flame paths and exist where two surfaces (which may include one or more parts of an electrical connector in which example in-line potting compounds are disposed) meet and provide a path, from inside the explosion-proof enclosure to outside the explosion-proof enclosure, along which one or more gases may travel. A joint may be a mating of any two or more surfaces. Each surface may be any type of surface, including but not limited to a flat surface, a threaded surface, and a serrated surface. By definition the potting compound used in example embodiments eliminates any potential flame-path it contacts by virtue of the testing requirements. Other flame-paths may still exist within the electrical connector. In other words, the potting compound creates a flameproof barrier, not a flame path.

In one or more example embodiments, an explosion-proof enclosure is subject to meeting certain standards and/or requirements. For example, the National Electrical Manufacturers Association (NEMA) sets standards with which an enclosure must comply in order to qualify as an explosion-proof enclosure. Specifically, NEMA Type 7, Type 8, Type 9, and Type 10 enclosures set standards with which an explosion-proof enclosure within a hazardous location must comply. For example, a NEMA Type 7 standard applies to enclosures constructed for indoor use in certain hazardous locations. Hazardous locations may be defined by one or more of a number of authorities, including but not limited to the National Electric Code (e.g., Class 1, Division I) and Underwriters' Laboratories, Inc. (UL) (e.g., UL 1203). For example, a Class 1 hazardous area under the National Electric Code is an area in which flammable gases or vapors may be present in the air in sufficient quantities to be explosive.

Examples of a hazardous location in which example embodiments can be used can include, but are not limited to, an airplane hanger, an airplane, a drilling rig (as for oil, gas, or water), a production rig (as for oil or gas), a refinery, a chemical plant, a power plant, a mining operation, and a steel mill.

As another example, Directive 94/9/EC of the European Union, entitled (in French) Appareils destinés à être utilisés en Atmosphères Explosibles (ATEX), sets standards for equipment and protective systems intended for use in potentially explosive environments. Specifically, ATEX 95 sets forth a minimum amount of shear strength that an electrical connector must be able to withstand. As yet another example, the International Electrotechnical Commission (IEC) develops and maintains the IECEx, which is the IEC system for certification to standards relating to equipment for use in explosive atmospheres. IECEx uses quality assessment specifications that are based on International Standards prepared by the IEC.

As a specific example, a potting compound within an electrical connector may be required to prevent gas and/or liquid from leaking through the electrical connector while under a pressure that is at least four times the pressure at which the electrical connector, without the potting compound disposed therein, ruptures (e.g., explodes). In testing, example electrical connectors having potting compound disposed therein can be tested for liquid leakage at high pressures to simulate whether gases may leak during normal operating conditions. In such a case, an applicable standard is ATEX/IECEx Standard 60079-1.

Example embodiments of potting compound chamber designs for electrical connectors will be described more fully hereinafter with reference to the accompanying drawings, in which example embodiments of potting compound chamber designs for electrical connectors are shown. Potting compound chamber designs for electrical connectors may, however, be embodied in many different forms and should not be construed as limited to the example embodiments set forth herein. Rather, these example embodiments are provided so that this disclosure will be thorough and complete, and will fully convey the scope of potting compound chamber designs for electrical connectors to those of ordinary skill in the art. Like, but not necessarily the same, elements (also sometimes called modules) in the various figures are denoted by like reference numerals for consistency.

Terms such as "first," "second," "end," "distal," and "proximal" are used merely to distinguish one component (or part of a component or state of a component) from another. Such terms are not meant to denote a preference or a particular orientation. Also, the names given to various components described herein are descriptive of example embodiments and are not meant to be limiting in any way. Those skilled in the art will appreciate that a feature and/or component shown and/or described in one embodiment (e.g., in a figure) herein can be used in another embodiment (e.g., in any other figure) herein, even if not expressly shown and/or described in such other embodiment.

FIG. 1 shows an electrical connector 100 currently known in the art. The electrical connector 100 can have a first end 110 and a second end 160 that are coupled to each other. The electrical connector end 110 can include a shell 111, an insert 150, a number of electrical coupling features 130, and a coupling sleeve 121. The shell 111 (also generally referred to as an electrical chamber 111) can include at least one wall 112 that forms a cavity 119. The shell 111 can be used to house some or all of the other components (e.g., the insert 150, the electrical coupling features 130) of the electrical connector end 110 within the cavity 119. The shell 111 can include one or more of a number of coupling features (e.g., slots, detents, protrusions) that can be used to connect the shell 111 to some other component (e.g., the shell 161 of a complementary electrical connector end 160) of an electrical connector and/or to an enclosure (e.g., a junction box, a panel). The shell 111 can be made of one or more of a number of materials, including but not limited to metal and plastic. The shell 111 can be made of one or more of a number of electrically conductive materials and/or electrically non-conductive materials. The shell 111 can include an extension 179 that couples to a portion (e.g., the body 173) of a complementary coupling sleeve (e.g., coupling sleeve 171). Also, the shell 111 can have an end 105 that is opposite the end in which the insert 150 is disposed.

The insert 150 can be disposed within the cavity 119 of the shell 111. One or more portions of the insert 150 can have one or more of a number of coupling features. Such coupling features can be used to couple and/or align the insert 150 with one or more other components (e.g., the inner surface 113 of the shell 111) of the electrical connector end 110. As an example, a recessed area (e.g., a notch, a slot) can be disposed in the outer perimeter of the insert 150. In such a case, each coupling feature can be used with a complementary coupling feature (e.g., a protrusion) disposed on the shell 111 to align the insert 150 with and/or mechanically couple the insert 150 to the shell 111.

The insert 150 can include one or more apertures that traverse through some or all of the insert 150. For example, there can be one or more apertures (hidden from view by the electrical coupling features 130, described below) disposed in various locations of the insert 150. In such a case, if there are multiple apertures, such apertures can be spaced in any of a number of ways and locations relative to each other. In certain example embodiments, one or more of the apertures can have an outer perimeter that is larger than the outer perimeter of the electrical coupling features 130. In such a case, there can be a gap between an electrical coupling feature 130 and the insert 150.

The one or more apertures for the electrical coupling features 130 can be pre-formed when the insert 150 is created. In such a case, the electrical coupling features 130 can be post-inserted into the respective apertures of the insert 150. Alternatively, the insert 150 can be overmolded around the electrical coupling features 130. The insert 150 can be made of one or more of a number of materials, including but not limited to plastic, rubber, and ceramic. Such materials can be electrically conductive and/or electrically non-conductive.

The one or more electrical coupling features 130 can be made of one or more of a number of electrically conductive materials. Such materials can include, but are not limited to, copper and aluminum. Each electrical coupling feature 130 is configured to mechanically and electrically couple to, at one (e.g., distal) end (hidden from view), one or more electrical conductors, and to mechanically and electrically couple to, at the opposite (e.g., proximal) end, another portion (e.g., complementary electrical coupling features) of an electrical connector. Any of a number of configurations for the proximal end and the distal end of an electrical coupling feature 130 can exist and are known to those of ordinary skill in the art. The configuration of the proximal end and/or the distal end of one electrical coupling feature 130 of the electrical connector end 110 can be the same as or different than the configuration of the proximal end and/or the distal end of the remainder of electrical coupling features 130 of the electrical connector end 110.

The electrical coupling features 130 can take on one or more of a number of forms, shapes, and/or sizes. Each of the electrical coupling features 130 in this case is shown to have substantially the same shape and size as the other electrical coupling features 130. In certain example embodiments, the shape and/or size of one electrical coupling feature 130 of an electrical connector end 110 can vary from the shape and/or size of one or more other electrical coupling features 130. This may occur, for example if varying amounts and/or types of current and/or voltage are delivered between the electrical coupling features 130.

One or more electrical cables (not shown) can be disposed within the cavity 119. Each electrical cable can have one or more electrical conductors made of one or more of a number of electrically conductive materials (e.g., copper, aluminum). Each conductor can be coated with one or more of a number of electrically non-conductive materials (e.g., rubber, nylon). Similarly, an electrical cable having multiple conductors can be covered with one or more of a number of electrically non-conductive materials. Each conductor of an electrical cable disposed within the cavity 119 can be electrically and mechanically coupled to an electrical coupling feature 130.

The coupling sleeve 121 can be disposed over a portion of the shell 111 and can include one or more coupling features 122 (e.g., mating threads) disposed on the body 123 of the coupling sleeve 121. The coupling sleeve 121, along with the coupling sleeve 171 of the electrical connector end 160, can make up the electrical connector coupling mechanism 120.

The coupling features 122 of the coupling sleeve 121 complement the coupling features 172 of the coupling sleeve 171 of the electrical connector end 160.

The electrical connector end 160 can include a shell 161, an insert 151, a number of electrical coupling features 180, and a coupling sleeve 171. The shell 161 can include at least one wall 162 that forms a cavity 169. The shell 161 can be used to house some or all of the other components (e.g., the insert 151, the electrical coupling features 180) of the electrical connector end 160 within the cavity 169. The shell 161 can include one or more of a number of coupling features (e.g., slots, detents, protrusions) that can be used to connect the shell 161 to some other component (e.g., the shell 111 of the complementary electrical connector end 110) of an electrical connector and/or to an enclosure (e.g., a junction box, a panel). The shell 161 can be made of one or more of a number of materials, including but not limited to metal and plastic. The shell 161 can be made of one or more of a number of electrically conductive materials and/or electrically non-conductive materials. Also, the shell 161 can have an end 155 that is opposite the end in which the insert 151 is disposed.

The insert 151 can be disposed within the cavity 169 of the shell 161. One or more portions of the insert 151 can have one or more of a number of coupling features. Such coupling features can be used to couple and/or align the insert 151 with one or more other components (e.g., the inner surface 163 of the shell 161) of the electrical connector end 160. As an example, a recessed area (e.g., a notch, a slot) can be disposed in the outer perimeter of the insert 151. In such a case, each coupling feature can be used with a complementary coupling feature (e.g., a protrusion) disposed on the shell 161 to align the insert 151 with and/or mechanically couple the insert 151 to the shell 161.

The insert 151 can include one or more apertures that traverse through some or all of the insert 151. For example, there can be one or more apertures (hidden from view by the electrical coupling features 180, described below) disposed in various locations of the insert 151. In such a case, if there are multiple apertures, such apertures can be spaced in any of a number of ways and locations relative to each other. In certain example embodiments, one or more of the apertures can have an outer perimeter that is larger than the outer perimeter of the electrical coupling features 180. In such a case, there can be a gap between an electrical coupling feature 180 and the insert 151.

The one or more apertures for the electrical coupling features 180 can be pre-formed when the insert 151 is created. In such a case, the electrical coupling features 180 can be post-inserted into the respective apertures of the insert 151. Alternatively, the insert 151 can be overmolded around the electrical coupling features 180. The insert 151 can be made of one or more of a number of materials, including but not limited to plastic, rubber, and ceramic. Such materials can be electrically conductive and/or electrically non-conductive.

The one or more electrical coupling features 180 can be made of one or more of a number of electrically conductive materials. Such materials can include, but are not limited to, copper and aluminum. Each electrical coupling feature 180 is configured to mechanically and electrically couple to, at one (e.g., distal) end (hidden from view), one or more electrical conductors, and to mechanically and electrically couple to, at the opposite (e.g., proximal) end, another portion (e.g., complementary electrical coupling features) of an electrical connector. Any of a number of configurations for the proximal end and the distal end of an electrical coupling feature 180 can exist and are known to those of ordinary skill in the art. The configuration of the proximal end and/or the distal end of one electrical coupling feature 180 of the electrical connector end 160 can be the same as or different than the configuration of the proximal end and/or the distal end of the remainder of electrical coupling features 180 of the electrical connector end 160.

The electrical coupling features 180 can take on one or more of a number of forms, shapes, and/or sizes. Each of the electrical coupling features 180 in this case is shown to have substantially the same shape and size as the other electrical coupling features 180. In certain example embodiments, the shape and/or size of one electrical coupling feature 180 of an electrical connector end 160 can vary from the shape and/or size of one or more other electrical coupling features 180. The shape, size, and configuration of the electrical coupling features 180 of the electrical connector end 160 can complement (be the mirror image of) the electrical coupling features 130 of the electrical connector end 110.

One or more electrical cables (not shown) can be disposed within the cavity 169. Such electrical cables are different from the electrical cables described above with respect to the electrical connector end 110, but can have similar characteristics (e.g., conductors, insulation, materials) as such cables. Each conductor of an electrical cable disposed within the cavity 169 can be electrically and mechanically coupled to an electrical coupling feature 180.

The coupling sleeve 171 of the electrical connector end 160 can be disposed over a portion of the shell 161 and can include one or more coupling features 172 (e.g., mating threads) disposed on the body 173 of the coupling sleeve 171. The coupling features 172 of the coupling sleeve 171 complement the coupling features 122 of the coupling sleeve 121 of the electrical connector end 110. One or more sealing devices (e.g., sealing device 152) can be used to provide a seal between the coupling sleeve 121 and the coupling sleeve 171.

Figure 2A:
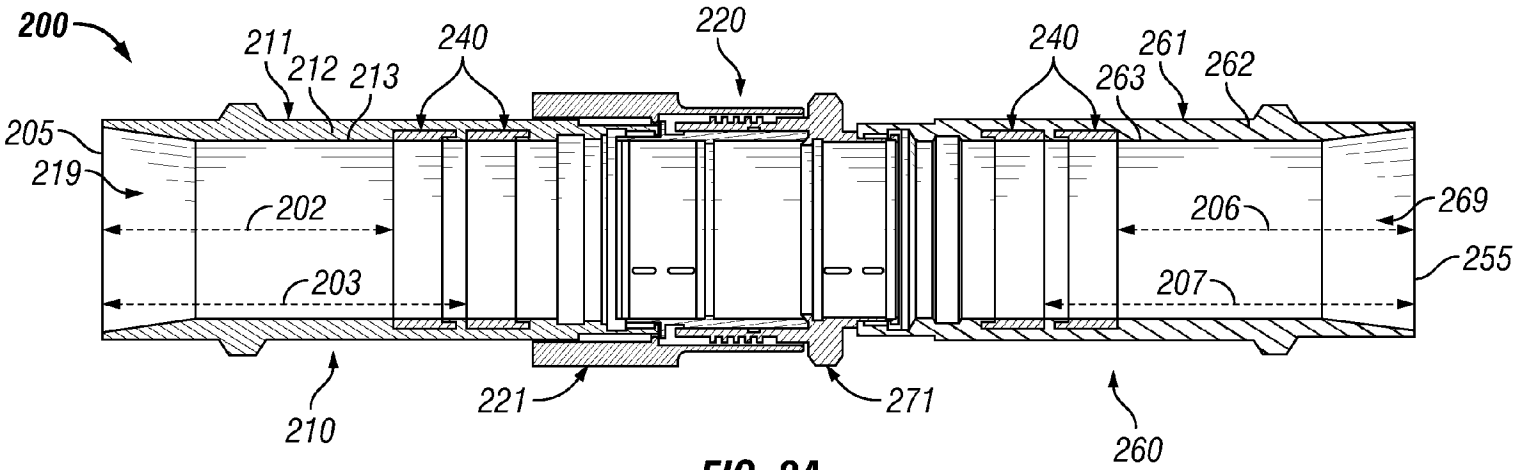
FIGS. 2A and 2B show an electrical connector end in accordance with certain example embodiments.
Figure 2B:
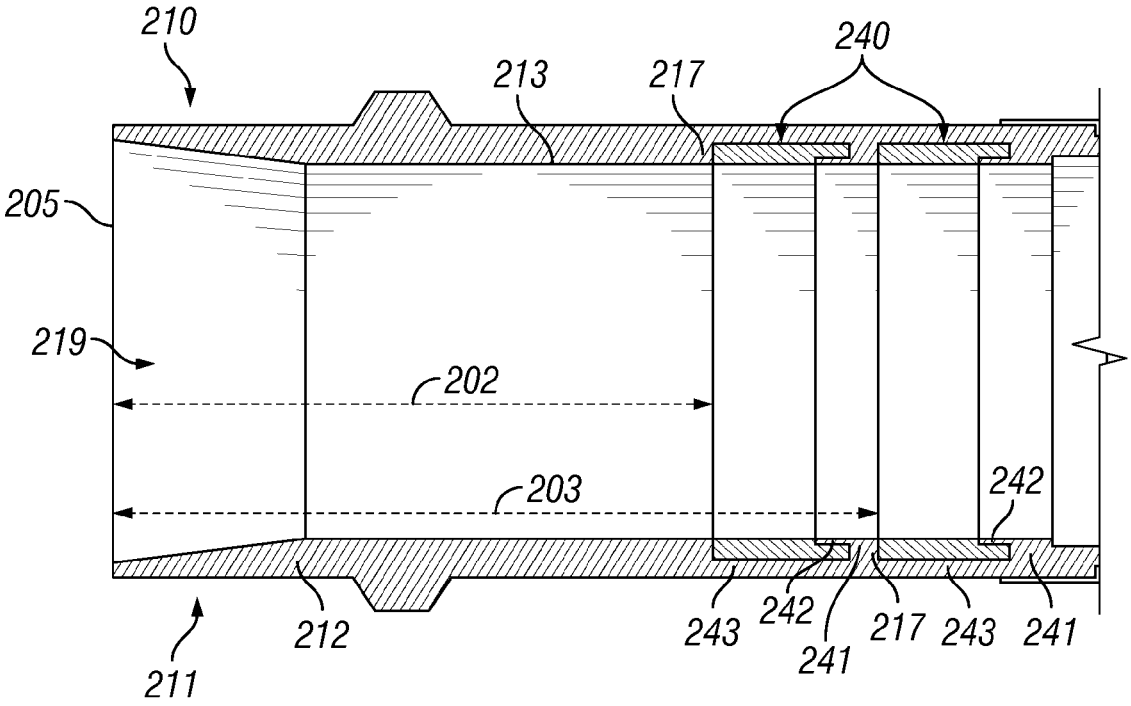

FIGS. 2A and 2B show various cross-sectional side views of an electrical connector end 200 in accordance with certain example embodiments. In one or more embodiments, one or more of the components shown in FIGS. 2A and 2B may be omitted, added, repeated, and/or substituted. Accordingly, embodiments of electrical connector ends should not be considered limited to the specific arrangements of components shown in FIGS. 2A and 2B.

The electrical connector end 200 of FIGS. 2A and 2B is substantially similar to the electrical connector end 100 of FIG. 1, except as described below. Any component described in FIGS. 2A and 2B can apply to a corresponding component having a similar label in FIG. 1. In other words, the description for any component of FIGS. 2A and 2B can be considered substantially the same as the corresponding component described with respect to FIG. 1. Further, if a component of FIGS. 2A and 2B is described but not expressly shown or labeled in FIGS. 2A and 2B, a corresponding component shown and/or labeled in FIGS. 2A and 2B can be inferred from the corresponding component of FIG. 1. The numbering scheme for the components in FIGS. 2A and 2B herein parallels the numbering scheme for the components of FIG. 1 in that each component is a three digit number having the identical last two digits.

Referring to FIGS. 1-2B, the electrical connector 200 of FIGS. 2A and 2B includes an electrical connector end 211 and an electrical connector end 262. The insert and the coupling features of the electrical connector end 200 of FIGS. 2A and 2B have been removed. The principal difference between the electrical connector end 200 of FIGS. 2A and 2B and the electrical connector end 100 of FIG. 1 are the addition of example isolation zones 240 to the shell 211 and the shell 261. In this case, two isolation zones 240 are disposed on the inner surface 213 of the wall 212 of the shell 211, and two isolation zones 240 are disposed on the inner surface 263 of the wall 262 of the shell 261. In certain example embodiments, there can be any number (e.g., one, two, three, six) of example isolation zones 240 disposed on a shell (e.g., shell 211, shell 261). When there are multiple isolation zones disposed on a shell, one isolation zone can be substantially the same as (e.g., size, shape, configuration), or different than, the other isolation zones. In this example, all of the isolation zones 240 disposed on the shell 211 and the shell 261 are substantially the same.

Each isolation zone 240 can be located some distance from an end (e.g., end 205, end 255) of the shell (e.g., shell 211, shell 261) on which the isolation zone is disposed. In this example, for shell 211, one of the isolation zones 240 is disposed a distance 202 from the end 205, while the other isolation zone 240 is disposed a distance 203 from the end 205, where distance 203 is greater than distance 202. In addition, for shell 261, one of the isolation zones 240 is disposed a distance 206 from the end 255, while the other isolation zone 240 is disposed a distance 207 from the end 255, where distance 207 is greater than distance 206. The distance measured can be from an end (e.g., end 205, end 255) of the shell (e.g., shell 211, shell 261) to any point of the isolation zone. In this case, each distance is measured to the part of the isolation zone inner surface 243 located closest to the end.

Example isolation zones can have any of a number of configurations and/or features. In this example, each of the isolation zones 240 shown in FIGS. 2A and 2B is formed by a bridge 241, an underhang 242, a roof 217, and an isolation zone inner surface 243. In certain example embodiments, an isolation zone 240 can be disposed continuously around all of the inner surface 213 at the distance (e.g., distance 202, distance 203) from the end (e.g., end 205, end 255). Alternatively, an isolation zone 240 can be disposed around one or more portions of the inner surface 213 at the distance from the end. In certain example embodiments, the isolation zones disposed on a shell are located on a different part of the inner surface of that shell compared to where the insert is located.

Figure 3:
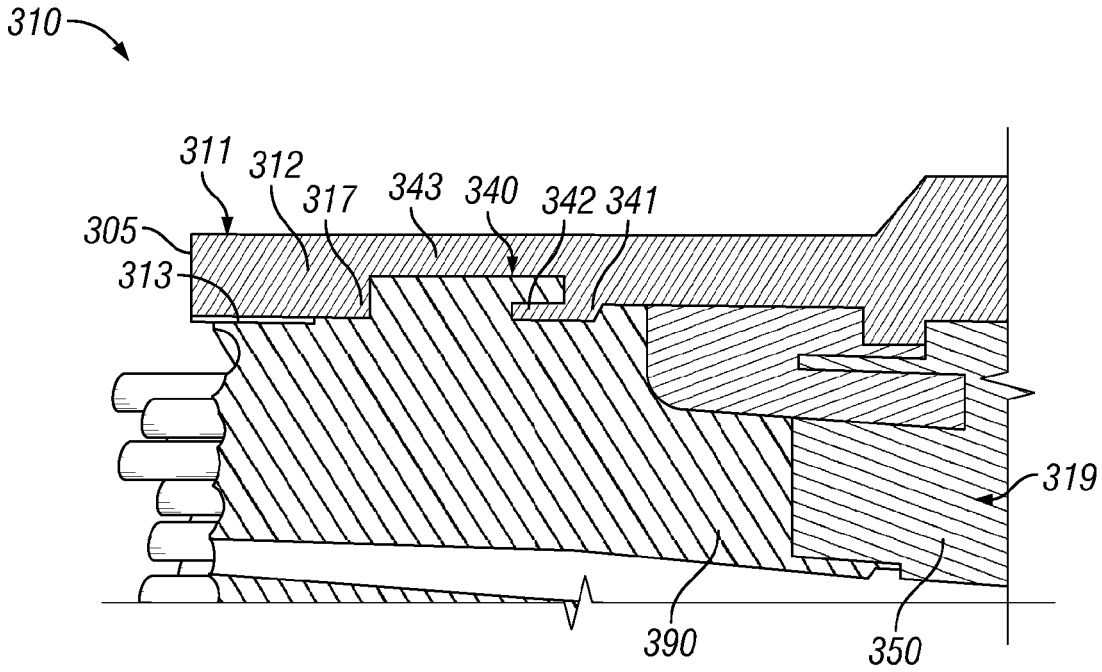
FIG. 3 shows a portion of another electrical connector end in accordance with certain example embodiments.

In certain example embodiments, the bridge 241 protrudes inward toward the cavity (e.g., cavity 219) of the shell (e.g., shell 211) from (relative to) the inner surface (e.g., inner surface 213) of the wall (e.g., 212) of the shell. As shown in FIG. 2B, the bridge 241 can protrude inward toward the cavity 219 at an angle that is substantially perpendicular to the inner surface 213. Alternatively, as shown for example in FIG. 3 below, some or all of the bridge can protrude inward from the inner surface at a non-normal angle (i.e., at some angle other than 90°). For example, as shown in FIG. 3 below, the top portion of the bridge 241 can form an obtuse angle with the inner surface 213 of the shell 211. The bridge 241 can have any height and/or can protrude any distance inward (i.e., thickness) from the inner surface 213 toward the cavity 219.

In some cases, such as shown in FIG. 2B, the distance that the bridge 241 protrudes inward is less than the distance from the inner surface 213 to the center of the cavity 219 along the length of the shell 211. For example, when the shell 211 forms a circle when viewed cross-sectionally along the length of the shell 211, the distance that the bridge 241 protrudes inward is less than the radius of the cross-sectional view of the cavity 219. In certain example embodiments, such as shown in FIGS. 2A and 2B, the bridge 241 is embedded in the wall 212 of the shell 211, so that the outer edge of the bridge 241 is planar with the inner surface 213 of the shell 211.

The underhang 242 (which can also be called an overhang, depending on its orientation) of an isolation zone 240 can extend from a distal end of the bridge 241 to which the underhang 242 is coupled. The underhang 242 and the bridge 241 can be formed from a single piece. Alternatively, the underhang 242 and the bridge 241 can be separate pieces that are mechanically coupled to each other, directly or indirectly, using one or more of a number of coupling methods, including but not limited to epoxy, compression fittings, fastening devices, mating threads, slots, and detents. The underhang 242 can have one or more of any number of thicknesses along its length. Also, the underhang 242 can have any suitable lengths. For example, the underhang 242 can be longer than, shorter than, or substantially the same length as the length of the isolation zone inner surface 243. In this case, the underhang is shorter than the length of the isolation zone inner surface 243.

In certain example embodiments, such as shown in FIGS. 2A and 2B, the underhang 242 is embedded in the wall 212 of the shell 211, so that the outer edge of the underhang 242 is planar with the inner surface 213 of the shell 211. In such a case, the underhang 242 is formed by removing a portion of the wall 212 between the inner surface 213 (which becomes the underhang 242) and the outer surface of the shell 211. The underhang 242 can also have any of a number of orientations within the cavity (e.g., cavity 119). For example, as shown in FIGS. 2A and 2B, the underhang 242 can be substantially parallel to (extends at an angle of approximately 0° relative to) the isolation zone inner surface 243. As another example, the underhang 242 can form an acute angle (extends at an angle less than 0°) relative to the isolation zone inner surface 243. Regardless of the orientation of the underhang 242, in certain example embodiments, the underhang 242 avoids physical contact with the isolation zone inner surface 243 and the inner surface 213 of the shell 211. The outer surface of the underhang 242 can be smooth. Alternatively, some or all of the outer surface of the underhang 242 can have one or more of a number of features (e.g., textured surface, sawtooth shape, curvatures).

In certain example embodiments, the isolation zone inner surface 243 is part of the inner surface 213 of the shell 211. The isolation zone inner surface 243 can have any of a number of orientations relative to the inner surface 213 of the shell 211. For example, as shown in FIGS. 2A and 2B, the isolation zone inner surface 243 can be recessed relative to the remainder of the inner surface 213 of the shell 211. As another example, the isolation zone inner surface 243 can be substantially planar to the remainder of the inner surface 213 of the shell 211. The isolation zone inner surface 243 can be smooth. Alternatively, some or all of the isolation zone inner surface 243 can have one or more of a number of features (e.g., textured surface, sawtooth shape, curvatures).

The roof 217 is positioned at the opposite end of the isolation zone 240 from the bridge 241. The roof 217 protrudes inward toward the cavity (e.g., cavity 219) of the shell (e.g., shell 211) from (relative to) the inner surface (e.g., inner surface 213) of the wall (e.g., 212) of the shell. As shown in FIG. 2B, the roof 217 can protrude inward toward the cavity 219 at an angle that is substantially perpendicular to the inner surface 213. Alternatively, as shown for example in FIG. 3 below, some or all of the bridge can protrude inward from the inner surface at a non-normal angle (i.e., at some angle other than 90°). For example, as shown in FIG. 3 below, the top portion of the roof 217 can form an obtuse angle with the inner surface 213 of the shell 211. The roof 217 can have any height and/or can protrude any distance inward (i.e., thickness) from the inner surface 213 toward the cavity 219.

In some cases, such as shown in FIG. 2B, the distance that the roof 217 protrudes inward is less than the distance from the inner surface 213 to the center of the cavity 219 along the length of the shell 211. For example, when the shell 211 forms a circle when viewed cross-sectionally along the length of the shell 211, the distance that the roof 217 protrudes inward is less than the radius of the cross-sectional view of the cavity 219. In certain example embodiments, such as shown in FIGS. 2A and 2B, the roof 217 is embedded in the wall 212 of the shell 211, so that the outer edge of the roof 217 is planar with the inner surface 213 of the shell 211.

In certain example embodiments, the dimensions of the roof 217 are determined based, at least in part, on a minimal shear stress that the electrical connector end 210 must experience without deformation in order to comply with one or more standards (e.g., ATEX 95). Shear stress directly proportional to the force applied to the electrical connector end 210 and indirectly proportional to the cross-sectional area that is parallel with the vector of the applied force. Thus, the height of the roof 217 can be based on the cross-sectional area required to maintain the shear stress below a certain level (e.g., below the shear strength of the material of the shell 211). Example embodiments can help the shell 211 to withstand a shear stress set forth in any applicable standard.

Similar considerations can apply with respect to one or more locations along the wall 212 of the shell 211 where an isolation zone 240 is disposed. For example, if a certain location along the length of the shell 211 is likely to experience excessive forces, then a bridge 241 can be placed at that location. Such considerations are important for an electrical connector end 211 to comply with a shear strength requirement of one or more standards, such as ATEX 95.

Any transition points involving the isolation zone 240 (e.g., transition point between the inner surface 213 and the roof 217, transition point between the roof 217 and the isolation zone inner surface 243, transition point between the isolation zone inner surface 243 and the bridge 241, transition point between the bridge 241 and the underhang 242, transition point between the bridge 241 and the inner surface 213) can be flat, rounded, angled, linear, curved, and/or have any other suitable feature.

FIG. 3 shows a portion of another electrical connector end 310 in accordance with certain example embodiments. In one or more embodiments, one or more of the components shown in FIG. 3 may be omitted, added, repeated, and/or substituted. Accordingly, embodiments of electrical connector ends should not be considered limited to the specific arrangements of components shown in FIG. 3.

The electrical connector end 310 of FIG. 3 is substantially similar to the electrical connector end 210 of FIGS. 2A and 2B, except as described below. Any component described in FIG. 3 can apply to a corresponding component having a similar label in FIGS. 2A and 2B. In other words, the description for any component of FIG. 3 can be considered substantially the same as the corresponding component described with respect to FIGS. 2A and 2B. Further, if a component of FIG. 3 is described but not expressly shown or labeled in FIG. 3, a corresponding component shown and/or labeled in FIG. 3 can be inferred from the corresponding component of FIGS. 2A and/or 2B. The numbering scheme for the components in FIG. 3 herein parallels the numbering scheme for the components of FIGS. 2A and 2B in that each component is a three digit number having the identical last two digits.

Referring to FIGS. 1-3, the electrical connector end 310 of FIG. 3 has only one isolation zone 340 disposed on the inner surface 313 of the wall 312 of the shell 311. Further, the components forming the isolation zone 340 of FIG. 3 have a different configuration than the components forming the isolation zones 240 of FIGS. 2A and 2B. Specifically, the top part of the bridge 341 of FIG. 3 forms an obtuse angle with the inner surface 313 of the wall 312 of the shell 311. Similarly, the roof 317 of FIG. 3 forms an obtuse angle with the inner surface 313 of the wall 312 of the shell 311. In addition, the wall 312 of the shell 311 has different thicknesses along its length. Specifically, the wall 312 is thicker to the left of the isolation zone 340 (where the roof 317 is located) relative to the wall 312 to the right of the isolation zone 340.

Further, the insert 350 is disposed within the cavity 319 of the shell 311. Also disposed within the cavity 319 of the shell 311, adjacent to the insert 350, is potting compound 390. Potting is a process of filling an electronic assembly (in this case, the cavity 319 and the isolation zone 340) with a solid or gelatinous compound (in this case, the potting compound 390) for resistance to shock and vibration, as well as for exclusion of moisture and corrosive agents. The potting compound 390 can include one or more of a number of materials, including but not limited to plastic, rubber, and silicone.

The potting compound 390 can be in one form (e.g., liquid) when it is inserted into the cavity 319 and the isolation zone 340 and, with time, transform into a different form (e.g., solid) while disposed inside the cavity 319 and the isolation zone 340. If the initial form of the potting compound 390 is liquid, the potting compound has a number of characteristics, including but not limited to a viscosity and electrical conductivity. These characteristics can dictate the dimensions (e.g., length, width) of the isolation zone 340 and/or the characteristics (e.g., features) of the bridge 341, the underhang 342, and the isolation zone inner surface 343 that forms the isolation zone 340. In addition, these characteristics can dictate whether an additional process (e.g., anodizing some or all of the shell 311) can be used to increase the effectiveness of the potting compound 390 (e.g., encourage covalent bonding).

In certain example embodiments, the potting compound 390 is used to prevent liquids (e.g., water) and/or gases from traveling from one end of the shell 311 to the other end of the shell 311, even at high pressure (e.g., 435 pounds per square inch (psi), 2000 psi, four times the pressure required to rupture the shell 311 without the potting compound 390). In some cases, the electrical connector (of which the electrical connector end 310 is a part) can be certified under ATEX standards. For example, if a pressure that is four times the pressure required to rupture the shell 311 without the potting compound 390 is applied to the electrical connector end 310 with the potting compound 390 disposed in the cavity 319, and if no liquids leak during this test, then the potting compound 390 disposed in the shell 31 is gas-tight (e.g., flameproof) and meets the standards as being flameproof under ATEX/IECEx Standard 60079-1. In other words, the potting compound 390 can create a barrier that prevents flame propogation.

As the potting compound 390 changes from an initial (e.g., liquid) state to a final (e.g., solid) state, the potting compound 390 can experience shrinkage. For example, if the potting compound 390 cures from a liquid state to a solid state, the potting compound can shrink by approximately 0.5%. This shrinkage can create gaps between the potting compound 390 and the inner surface 313 of the shell 311. Such gaps can allow fluids to seep therethrough, especially at higher pressures. Shrinkage and expansion of the potting compound 390 can also occur during normal operating conditions due to factors such as temperature and pressure.

As a result, the shrinkage in the potting compound 390 can cause actual gas leakage within the electrical connector, cause an electrical connector to fail a leakage test (also called a blotting test), cause an electrical connector to fail a shear stress test under the ATEX 95 standard, and/or create other issues that can affect the reliability of the electrical connector. As an example, if the diameter of the inner surface 313 of the shell 311 is approximately 2.5 inches, the total shrinkage of the potting compound 390 can be a total of approximately 0.0125 inches, which amounts to approximately 0.006 inches at any point along the inner surface 313 of the wall 312 of the shell 311. Especially at higher pressures, 0.006 inches can be a large enough gap to allow fluids and/or gases to pass along the length of the shell 311.

By integrating one or more example isolation zones 340 into the electrical connector end 310, the effects of the shrinkage of the potting compounds on a pressurized leakage test are greatly reduced. For example, if the distance between the underhang 342 and the isolation zone inner surface 343 is approximately 0.08 inches, the total shrinkage of the potting compound 390 can be a total of approximately 0.0004 inches, which amounts to approximately 0.0002 inches at any point along the portions of the underhang 342, the ramp 341, and the isolation zone inner surface 343 that form the isolation zone 340. Even at higher pressures, 0.0004 inches is too small to allow fluids to pass along the length of the shell 311. In addition, the approximate "C" shape (and the orientation of the "C" shape relative to the inner surface 313 of the shell 311) along the portions of the underhang 342, the ramp 341, and the isolation zone inner surface 343 that form the isolation zone 340 help to prevent gases and/or liquids from leaking through the electrical connector end 310 (create a gas-tight and/or a liquid-tight seal).

Figure 6:
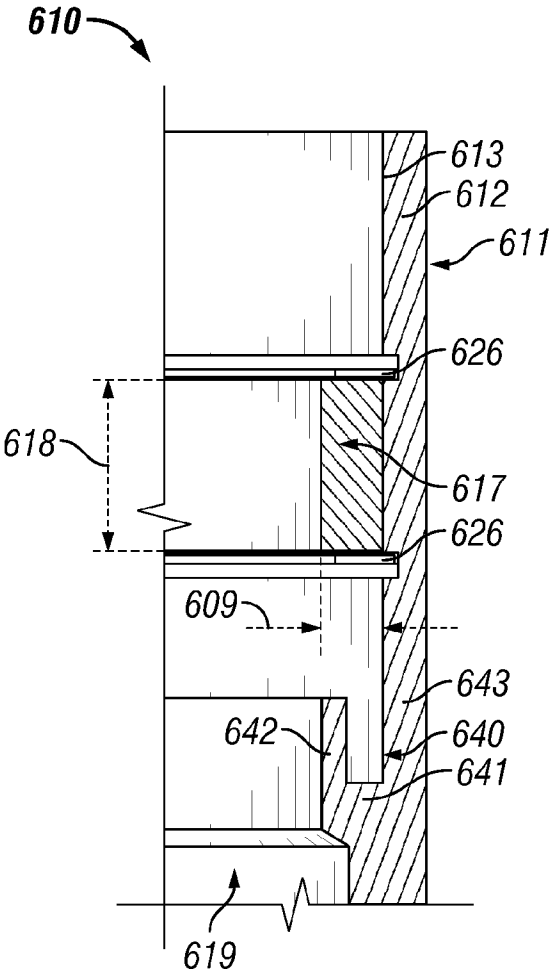
FIG. 6 shows a portion of yet another electrical connector end in accordance with certain example embodiments.
Figure 5:
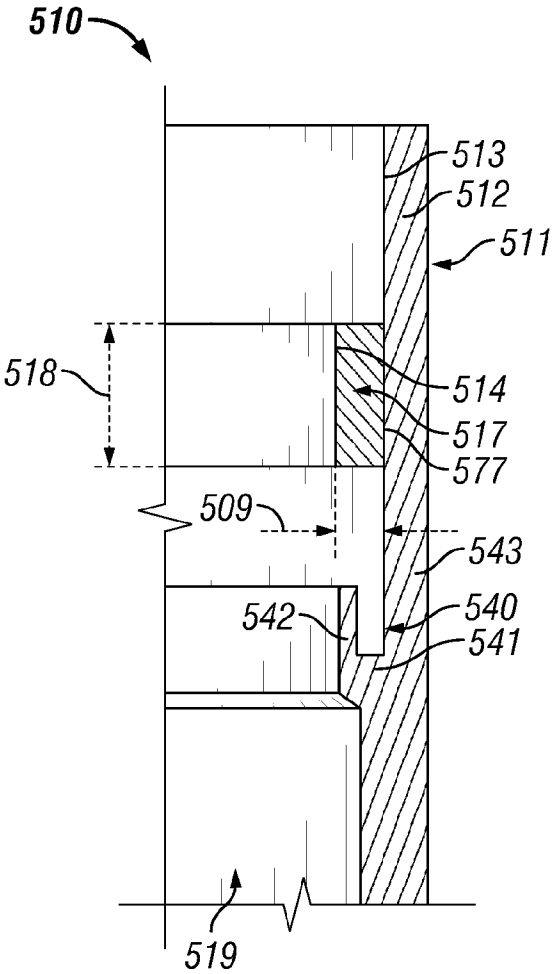
FIG. 5 shows a portion of still another electrical connector end in accordance with certain example embodiments.
Figure 4:
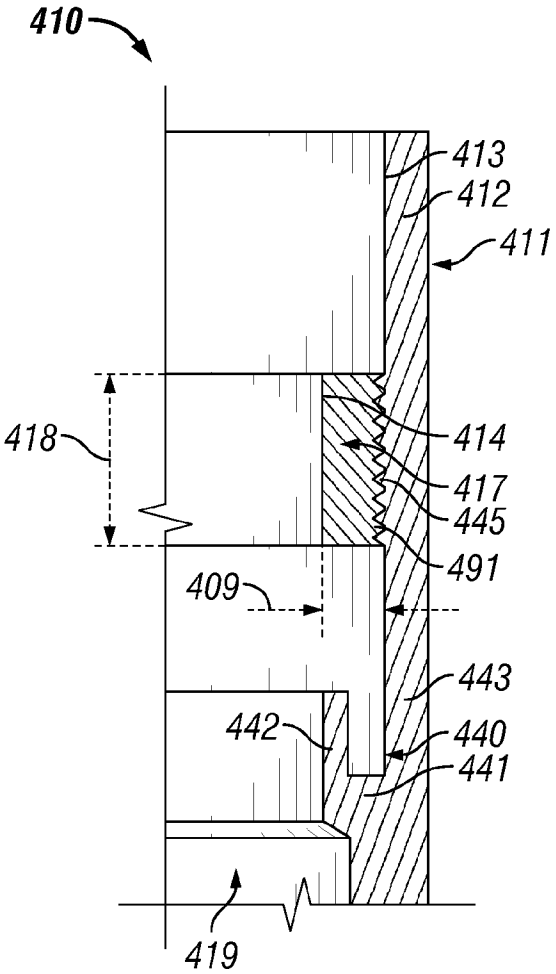
FIG. 4 shows a portion of yet another electrical connector end in accordance with certain example embodiments.
Figure 7:
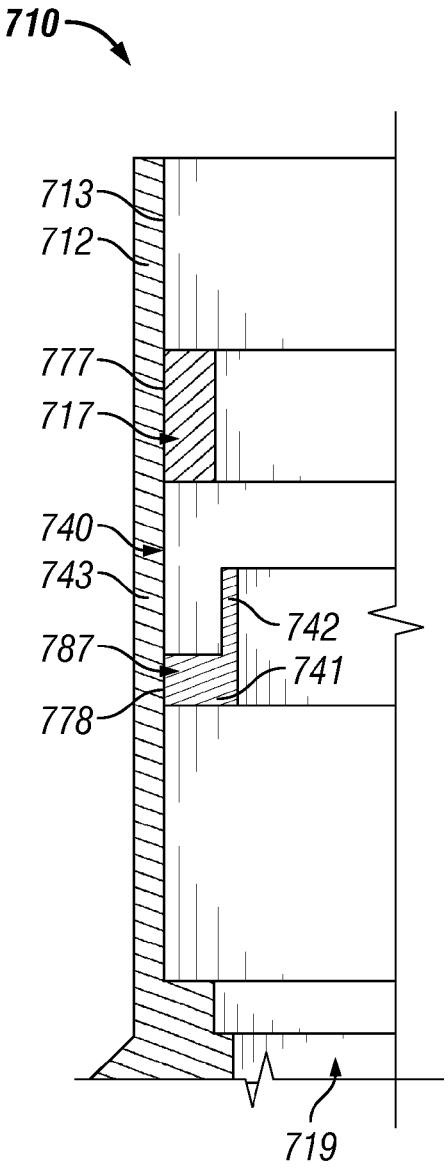
FIG. 7 shows a portion of still another electrical connector end in accordance with certain example embodiments.

FIGS. 4-7 show different ways in which a ramp, an underhang, and/or an isolation zone inner surface that forms an isolation zone can be manufactured. FIG. 4 shows a portion of yet another electrical connector end 410 in accordance with certain example embodiments. FIG. 5 shows a portion of still another electrical connector end 510 in accordance with certain example embodiments. FIG. 6 shows a portion of yet another electrical connector end 610 in accordance with certain example embodiments. FIG. 7 shows a portion of still another electrical connector end 710 in accordance with certain example embodiments. In one or more embodiments, one or more of the components shown in FIGS. 4-7 may be omitted, added, repeated, and/or substituted. Accordingly, embodiments of electrical connector ends should not be considered limited to the specific arrangements of components shown in FIGS. 4-7.

The electrical connector end 410 of FIG. 4, the electrical connector end 510 of FIG. 5, the electrical connector end 610 of FIG. 6, and the electrical connector end 710 of FIG. 7 are substantially similar to the electrical connector end 210 of FIGS. 2A and 2B and the electrical connector end 310 of FIG. 3, except as described below. Any component described in FIGS. 4-7 can apply to a corresponding component having a similar label in FIGS. 2A-3. In other words, the description for any component of FIGS. 4-7 can be considered substantially the same as the corresponding component described with respect to FIGS. 2A-3. Further, if a component of FIGS. 4-7 is described but not expressly shown or labeled in FIGS. 4-7, a corresponding component shown and/or labeled in FIGS. 4-6 can be inferred from the corresponding component of FIGS. 2A, 2B, and/or 3. The numbering scheme for the components in FIGS. 4-7 herein parallels the numbering scheme for the components of FIGS. 2A-3 in that each component is a three digit number having the identical last two digits.

Referring to FIGS. 1-7, the isolation zones 240 of FIGS. 2A and 2B and the isolation zones 340 of FIG. 3 can be formed by using a machining process. By contrast, the isolation zones of FIGS. 4-7 are formed, at least in part, by using one or more components that are inserted within the cavity of the shell. For example, for the electrical connector end 410 of FIG. 4, mating threads 445 can be disposed along some or all of the length of the inner surface 413 of the wall 412 of the shell 411. In such a case, an insert 417 can be disposed within the cavity 419 and coupled to the inner surface 413 of the shell 411 using complementary mating threads 491 disposed along the outer surface of the insert 417. In this case, the insert 417 is the roof that helps form the isolation zone 440.

The insert 417 can have any shape and/or size suitable for the shape and size of the desired isolation zone 440 and/or for the desired reinforcement, adding to the shear strength of the shell 411. In this case, the insert 417 is substantially rectangular when viewed cross-sectionally, having a height 418 and a width 409. In this case, the insert 417 defines the length of the isolation zone inner surface 443. The bridge 441 and the underhang 442 in this case are machined into place within the inner surface 413 of the wall 412.

As another example, for the electrical connector end 510 of FIG. 5, one or more detents 577 can be disposed along some or all of the length of the inner surface 513 of the wall 512 of the shell 511. In such a case, an insert 517 can be disposed within the cavity 519 and coupled to the inner surface 513 of the shell 511 by press fitting the insert 517 into the detent 577. In this case, the insert 517 is the roof that helps form the isolation zone 540. As with the insert 417 of FIG. 4, the insert 517 in this case is substantially rectangular when viewed cross-sectionally, having a height 518 and a width 509. In this case, the insert 517 defines the length of the isolation zone inner surface 543. The bridge 541 and the underhang 542 in this case are machined into place within the inner surface 513 of the wall 512.

As yet another example, for the electrical connector end 610 of FIG. 6, one or more snap fittings 626 can be disposed along some or all of the length of the inner surface 613 of the wall 612 of the shell 611. In such a case, an insert 617 can be disposed within the cavity 619 and coupled to the inner surface 613 of the shell 611 by snapping the insert 617 into the snap fittings 626. In this case, the insert 617 is the roof that helps form the isolation zone 640. As with the insert 417 of FIG. 4, the insert 617 in this case is substantially rectangular when viewed cross-sectionally, having a height 618 and a width 609. In this case, the insert 617 defines the length of the isolation zone inner surface 643. The bridge 641 and the underhang 642 in this case are machined into place within the inner surface 613 of the wall 612.

As still another example, for the electrical connector end 710 of FIG. 7, a one or more detents 777 can be disposed along some or all of the length of the inner surface 713 of the wall 712 of the shell 711. In such a case, two inserts can be used. Insert 717 can be disposed within the cavity 719 and coupled to the inner surface 713 of the shell 711 by press fitting the insert 717 into the detent 777. In this case, the insert 717 is the roof that helps form the isolation zone 740. As with the insert 417 of FIG. 4, the insert 717 in this case is substantially rectangular when viewed cross-sectionally, having a height 718 and a width 709. In this case, the insert 717 defines the length of the isolation zone inner surface 743.

Insert 787 can also be disposed within the cavity 719 and coupled to the inner surface 713 of the shell 711 by press fitting the insert 787 into a different detent 778. The insert 787 in this case includes the bridge 741 and the underhang 742. Thus, the isolation zone 740 is positioned between and defined by the insert 787 and the insert 717.

Figure 8:
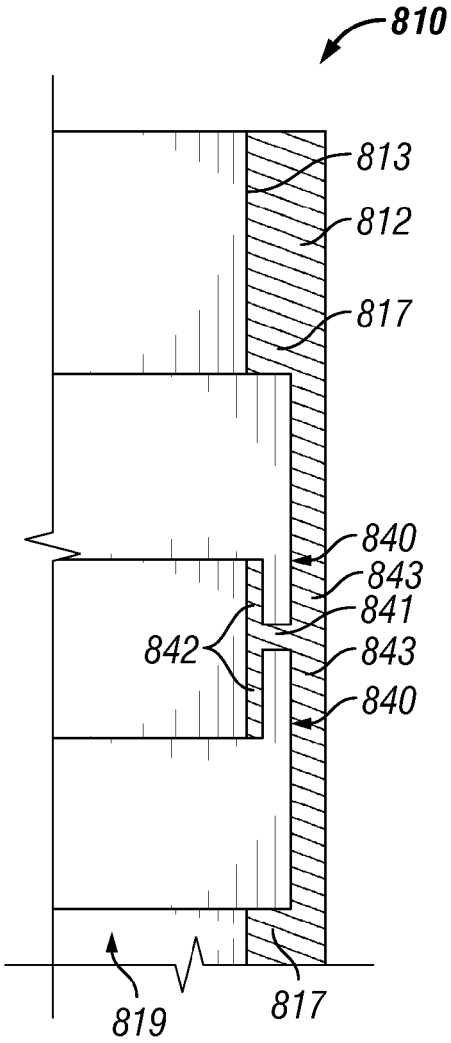
FIG. 8 shows a portion of yet another electrical connector end in accordance with certain example embodiments.

FIG. 8 shows a portion of yet another electrical connector end 810 in accordance with certain example embodiments. In one or more embodiments, one or more of the components shown in FIG. 8 may be omitted, added, repeated, and/or substituted. Accordingly, embodiments of electrical connector ends should not be considered limited to the specific arrangements of components shown in FIG. 8.

The electrical connector end 810 of FIG. 8 is substantially similar to the electrical connector end 210 of FIGS. 2A and 2B, except as described below. Any component described in FIG. 8 can apply to a corresponding component having a similar label in FIGS. 2A and 2B. In other words, the description for any component of FIG. 8 can be considered substantially the same as the corresponding component described with respect to FIGS. 2A and 2B. Further, if a component of FIG. 8 is described but not expressly shown or labeled in FIG. 8, a corresponding component shown and/or labeled in FIG. 8 can be inferred from the corresponding component of FIGS. 2A and/or 2B. The numbering scheme for the components in FIG. 8 herein parallels the numbering scheme for the components of FIGS. 2A and 2B in that each component is a three digit number having the identical last two digits.

Referring to FIGS. 1-8, the electrical connector end 810 of FIG. 8 shows how the orientation of multiple isolation zones 840 can vary. Specifically, in this case, there are two isolation zones 840 that face each other (as opposed to being oriented in the same direction as in FIGS. 2A and 2B). The bridge 841 in this case is common for both isolation zones 841, and the two underhangs 842 extend from the distal end of the bridge 841 in opposite directions. Similarly, the isolation zone inner surfaces 843 of the two isolation zones 840 extend in opposite directions from each other. In certain example embodiments, the isolation zones 840 have enough separation between them that each isolation zone 840 has its own separate bridge 841. In such a case, the underhang 842 of one isolation zone extends from the bridge 841 to which it is attached in one direction, and the underhang 842 extends of the other isolation zone 840 extends from the bridge 841 to which it is attached in an opposite direction.

Figure 9A:
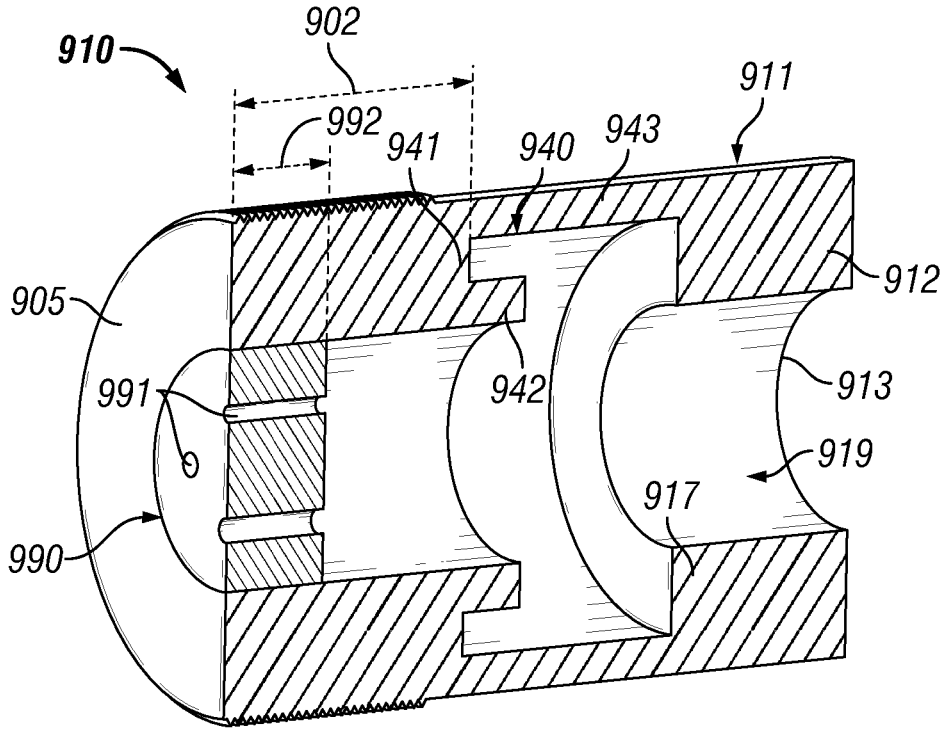
FIGS. 9A and 9B show a portion of still another electrical connector end in accordance with certain example embodiments.
Figure 9B:
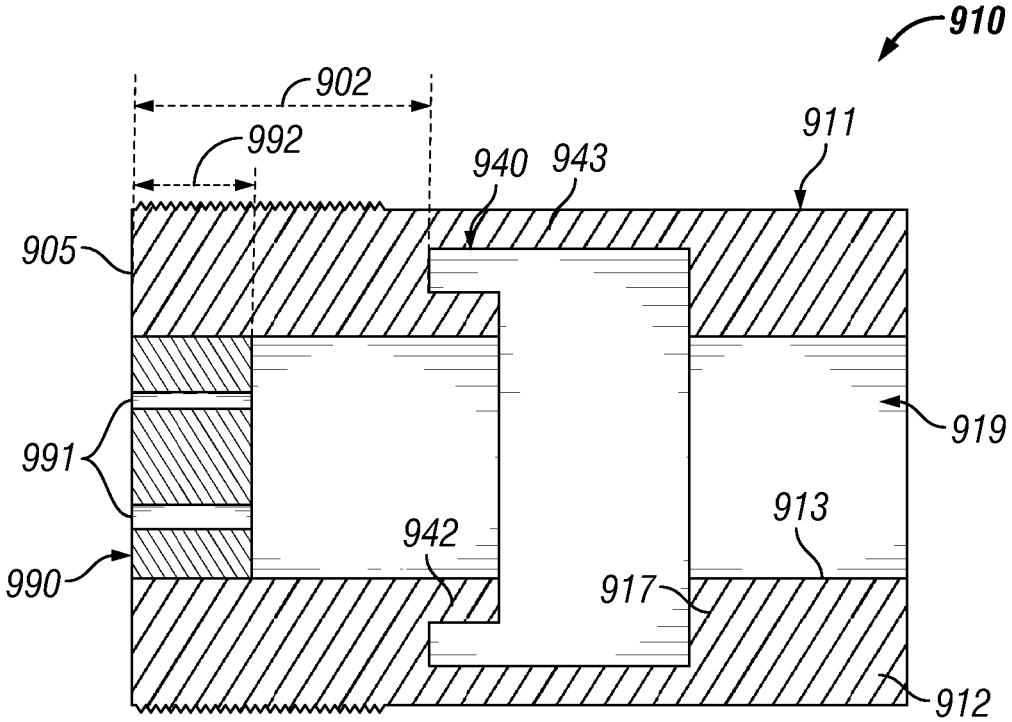

FIGS. 9A and 9B (collectively "FIG. 9") show a portion of yet another electrical connector end 910 in accordance with certain example embodiments. In one or more embodiments, one or more of the components shown in FIG. 9 may be omitted, added, repeated, and/or substituted. Accordingly, embodiments of electrical connector ends should not be considered limited to the specific arrangements of components shown in FIG. 9.

The electrical connector end 910 of FIG. 9 is substantially similar to the electrical connector end 210 of FIGS. 2A and 2B, except as described below. Any component described in FIG. 9 can apply to a corresponding component having a similar label in FIGS. 2A and 2B. In other words, the description for any component of FIG. 9 can be considered substantially the same as the corresponding component described with respect to FIGS. 2A and 2B. Further, if a component of FIG. 9 is described but not expressly shown or labeled in FIG. 9, a corresponding component shown and/or labeled in FIG. 9 can be inferred from the corresponding component of FIGS. 2A and/or 2B. The numbering scheme for the components in FIG. 9 herein parallels the numbering scheme for the components of FIGS. 2A and 2B in that each component is a three digit number having the identical last two digits.

Referring to FIGS. 1-9, the electrical connector end 910 of FIG. 9 shows how other components (e.g., a grommet 990, a sealing member, a damming device) can be disposed within the cavity 919 of the shell 911 without affecting the functionality of the isolation zone 940. In other words, the example isolation zone 940 can be positioned away from one or both ends (e.g., end 905) of the shell 911. In this case, the grommet 990 is positioned within the cavity 919 and is substantially flush with the end 905 of the shell 911. The grommet 990 has a thickness 992 that extends into the cavity 919.

The isolation zone 940 is positioned a distance 902 from the end 905, where the distance 902 is greater than the thickness 992 of the grommet 990. In such a case, one or more electrical cables (or one or more conductors from one or more electrical cables) can be pulled through the apertures 991 that traverse the thickness 992 of the grommet 990 and become electrically and mechanically coupled to one or more electrical coupling features disposed is an insert (all not shown) within the cavity 919. Subsequently, a potting compound (not shown) can be injected through one or more of the apertures 991 in the grommet 990 so that the potting compound is disposed between the grommet 990 and the insert.

The systems and methods described herein allow an electrical chamber to be used in hazardous environments and potentially explosive environments. Specifically, example embodiments allow electrical chambers (e.g., electrical connector ends, junction boxes, light fixtures) to comply with one or more standards (e.g., ATEX 95) that apply to electrical devices located in such environments. Example embodiments also allow for reduced manufacturing time and costs of electrical chambers. Example embodiments also provide for increased reliability of electrical equipment that is electrically coupled to electrical chambers.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An electrical chamber, comprising:

at least one wall forming a cavity, wherein the at least one wall comprises a first end and an inner surface; and a first isolation zone disposed in the at least one wall adjacent to the inner surface at a first distance from the first end, wherein the first isolation zone is formed by a first underhang, a first roof, and a first isolation zone inner surface, wherein the first roof extends from the first isolation zone inner surface toward the cavity, and wherein the first underhang extends toward the first roof along the at least one wall without contacting the first roof, wherein the first isolation zone is in communication with the cavity, wherein the first underhang and the first isolation zone inner surface are disposed at opposite ends of the first isolation zone, and wherein the cavity is configured to receive at least one electrical conductor, and wherein the cavity and the first isolation zone are configured to receive a potting compound.

2. The electrical chamber of claim 1, wherein the first underhang extends at an angle relative to the first isolation zone inner surface.

3. The electrical chamber of claim 1, wherein the first underhang avoids contact with the first isolation zone inner surface, the roof, and a remainder of the inner surface.

4. The electrical chamber of claim 1, wherein the first isolation zone inner surface is recessed relative to a remainder of the inner surface.

5. The electrical chamber of claim 1, wherein the first isolation zone further comprises a first bridge that protrudes substantially perpendicularly from the inner surface, and wherein the first underhang extends substantially perpendicularly from the first bridge.

6. The electrical chamber of claim 1, wherein the electrical chamber further comprises:

a second isolation zone disposed on the inner surface at a second distance from the first end, wherein the second isolation zone is formed by a second underhang, a second roof, and a second isolation zone inner surface, wherein the second roof protrudes inward extends from the second isolation zone inner surface toward the cavity, and wherein the second underhang extends toward the second roof along the at least one wall without contacting the second roof.

7. The electrical chamber of claim 6, wherein the second distance is greater than the first distance.

8. The electrical chamber of claim 6, wherein the first isolation zone further comprises a first bridge, wherein the second isolation zone further comprises a second bridge, wherein the first underhang extends from the first bridge in a first direction, and the second underhang extends from the second bridge in the first direction.

9. The electrical chamber of claim 6, wherein the first isolation zone further comprises a first bridge, wherein the second isolation zone further comprises a second bridge, wherein the first underhang extends from the first bridge in a first direction, and the second underhang extends from the second bridge in a second direction, wherein the first direction is opposite the second direction.

10. The electrical chamber of claim 1, wherein the first roof protrudes toward the cavity relative to the inner surface.

11. The electrical chamber of claim 1, wherein the first roof comprises a top portion that forms an obtuse angle with the inner surface.

12. The electrical chamber of claim 1, wherein the first underhang, the first roof, and the first isolation zone inner surface are formed by machining the at least one wall.

13. The electrical chamber of claim 1, wherein the first underhang is mechanically coupled to the at least one wall.

14. The electrical chamber of claim 13, wherein the first roof is mechanically coupled to the at least one wall.

15. An electrical connector, comprising:

an electrical chamber, comprising:

at least one wall forming a cavity, wherein the at least one wall comprises a first end and an inner surface;

an isolation zone disposed in the at least one wall adjacent to the inner surface at a distance from the first end, wherein the isolation zone is formed by an underhang, a roof, and an isolation zone inner surface, wherein the roof extends toward the cavity from the isolation zone inner surface, wherein the underhang extends toward the first roof along the at least one wall without contacting the first roof, wherein the isolation zone is in communication with the cavity, and wherein the first underhang and the first isolation zone inner surface are disposed at opposite ends of the first isolation zone;

at least one electrical conductor disposed within the cavity; and a potting compound disposed within the cavity and the first isolation zone, and disposed around the at least one electrical conductor.

16. The electrical connector of claim 15, wherein the potting compound creates a gas-tight seal within the first isolation zone.

17. The electrical connector of claim 15, further comprising:

a mechanical sealing member disposed adjacent to the inner surface at a second distance from the first end.

18. The electrical connector of claim 16, wherein the potting compound creates a flameproof barrier within the cavity of the electrical chamber.

19. The electrical connector of claim 16, wherein the gas-tight seal withstands at least four times a pressure required to rupture the at least one wall of the electrical chamber.

20. An electrical chamber, comprising:

at least one wall forming a cavity, wherein the at least one wall comprises an end and an inner surface; and an isolation zone disposed within the cavity at a distance from the end, wherein the isolation zone is formed by a bridge, an underhang, a roof, and an isolation zone inner surface, wherein the bridge and the roof each protrudes away from the inner surface toward the cavity, wherein the underhang extends from a distal end of the bridge toward the roof along the at least one wall without contacting the roof, wherein the bridge and the roof are disposed at opposite first ends of the isolation zone, wherein the underhang and the isolation zone inner surface are disposed at opposite second ends of the isolation zone, wherein the opposite first ends are substantially transverse to the opposite second ends, wherein the cavity is configured to receive at least one electrical conductor, and wherein the cavity and the isolation zone are configured to receive a potting compound.

* * * * *